United States Patent [19]

Bruhlmeier et al.

[11] 3,937,132

[45] Feb. 10, 1976

[54] AIR OUTLET APPARATUS

[75] Inventors: Josef Bruhlmeier, Wettingen; Andreas Gasser, Zurich, both of Switzerland

[73] Assignee: Luwa AG, Zurich, Switzerland

[22] Filed: June 17, 1974

[21] Appl. No.: 480,020

[30] Foreign Application Priority Data

June 19, 1973 Switzerland ..... 8859/73

[52] U.S. Cl. ..... 98/40 N; 239/551

[51] Int. Cl.[2] ..... F24F 13/08

[58] Field of Search ..... 98/36, 40 R, 40 A, 40 C, 98/40 N; 34/104; 239/550, 551

[56] References Cited

UNITED STATES PATENTS

| | | | |
|---|---|---|---|
| 832,247 | 10/1906 | Edwards | 98/40 C |
| 2,571,583 | 10/1951 | Kolbach | 239/551 |
| 2,938,449 | 5/1960 | Newell, Jr. et al. | 98/40 C |
| 3,441,082 | 4/1969 | Fragnito et al. | 98/40 C |
| 3,452,667 | 7/1969 | Coleman et al. | 98/40 C |
| 3,736,858 | 6/1973 | Mercier | 98/40 C |

FOREIGN PATENTS OR APPLICATIONS

| | | | |
|---|---|---|---|
| 1,177,390 | 1/1970 | United Kingdom | 98/40 N |

*Primary Examiner*—Carroll B. Dority, Jr.
*Assistant Examiner*—Ronald C. Capossela
*Attorney, Agent, or Firm*—Werner W. Kleeman

[57] ABSTRACT

An air outlet apparatus comprising a housing connected through the agency of at least one opening and at least one infeed conduit with an air preparation installation. According to the invention the housing comprises an elongate tubular-like body and a multiplicity of outlet openings, the outlet openings are distributively arranged in the axial direction of the tubular-like body in at least one outer wall of the housing and the tubular-like body is connected with said at least one infeed conduit.

17 Claims, 2 Drawing Figures

AIR OUTLET APPARATUS

BACKGROUND OF THE INVENTION

The present invention relates to a new and improved construction of an air outlet apparatus incorporating a housing which is connected through the agency of at least one opening and at least one delivery or infeed conduit with an air preparation installation.

There are already known to the art different types and constructions of air outlet apparatuses. Most such equipment is associated with a specific field of use, for instance an air conducting channel or a climatizing device.

SUMMARY OF THE INVENTION

It is a primary object of the present invention to provide an improved construction of air outlet apparatus capable of being employed for a number of different uses and in particular capable of being optimumly employed for its various possible uses without the need to carry out any change in its construction.

Another object of the present invention aims at the provision of an improved construction of air outlet apparatus enabling the adjustment of the quantity of air flowing out of such apparatus and furthermore enabling the series connection of a number of such apparatuses.

Now in order to implement these and still further objects of the invention, which will become more readily apparent as the description proceeds, the air outlet apparatus of this development is manifested by the features that the housing is equipped with an elongate tubular-like body and a multiplicity of outlet openings, the outlet openings are distributively arranged in the axial direction of the tubular-like body in at least one outer wall of the housing and the tubular-like body is connected with at least one infeed conduit or line.

BRIEF DESCRIPTION OF THE DRAWING

The invention will be better understood and objects other than those set forth above, will become apparent when consideration is given to the following detailed description thereof. Such description makes reference to the annexed drawing wherein.

DETAILED DESCRIPTION OF THE PREFERRED EMBODIMENTS

Figure 1:
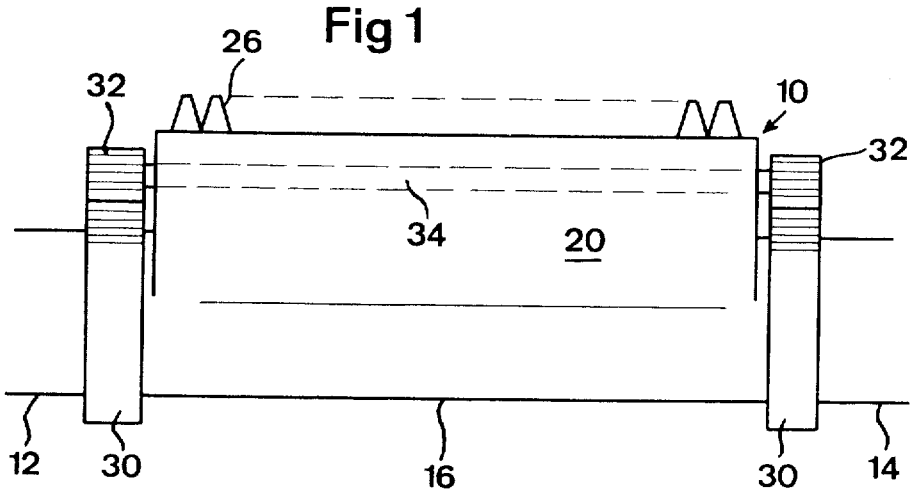
FIG. 1 is a schematic side view of a preferred constructional embodiment of air outlet apparatus.

Describing now the drawing, reference numeral 10 designates the housing of an air outlet appratus designed according to the teachings of the present invention as depicted herein by way of example and embodying a substantially tubular-like or pipe-like body 16 and a mounting or attachment 20. The tubular-like body 16 can possess any desired cross-sectional configuration although it preferably possesses a substantially cylindrical cross-section. The tubular-like body, in this case in the form of a tube or pipe 16 is connected at both of its ends with infeed conduits or lines 12 and 14 for air serving for climatizing or ventilation. According to a preferred construction of the invention the cross-section of the tube 16 is circular in shape and possesses the same diameter as the diameter of the infeed conduits 12 and 14. However, it also can only be equipped with a single infeed conduit 12 or 14 which, in the showing of FIG. 1, can be connected at the left-hand or the right-hand side of the tube or pipe 16. The infeed conduit or conduits also however can open into the tube or pipe 16 radially or at an inclination.

Continuing, the tubular-like body or tube 16 is equipped at a portion of its periphery for instance extending through about 60°— with openings or throughpassages 18, for instance in the form of circular holes or equivalent structure. Preferably these openings or throughpassage openings 18 extend over the entire length of the tubular-like body or tube 16 and are not uniformly distributed over the periphery or jacket of the tube 16. The number of such throughpassage openings 18, for instance, can decrease in the peripheral direction towards the location A.

The mounting or attachment 20 is arranged at the region of the throughpassage openings 18 and encloses by means of its outer wall 20*a* a compartment 22. According to a preferred embodiment of the invention the mounting 20 extends as far as the openings 18, i.e., approximately over the length of the tube or pipe 16, and the width of the mounting 20 approximately corresponds to the diameter of the tube 16. The width of the mounting or attachment 20 however also can be less than the diameter of the tube 16. According to a preferred further construction of the preferred embodiment the height H of the compartment or chamber 22 or the mounting 20 respectively, measured at the highest location of the tube amounts to about 10 to 40% of the diameter of the tube 16. It has been found to be particularly advantageous if there is provided a height of 18 to 30% of the tube diameter. At the surface 24 forming the top surface of the mounting or attachment 20, this surface limiting the height of the compartment 22, there are arranged a multiplicity of outlet openings here shown in the form of nozzles 26. These nozzles 26 are advantageously distributively mounted at a uniform spacing and over the entire length of the compartment 22. The nozzles 26 can be arranged in one or a number of rows and fixedly mounted or exchangeably mounted.

Within the tube or pipe 16 there is rotatably mounted a throttle slide member or throttle slide 28. In a preferred embodiment the throttle slide 28 is rotatable about the lengthwise axis of the tube or pipe 16. According to a further construction of the preferred embodiment the throttle slide 28 consists of a thin foil, formed of metal or plastic by way of example, and which bears against the inner periphery or wall of the tube 16 as shown. The throttle slide 28 extends in the peripheral direction for such an extent that all of the throughpassage openings 18 can be closed.

Additionally, it is to be appreciated that the throttle slide 28 can be adjusted into desired position by means of a suitable adjustment mechanism. In particular, the throttle slide 28, in the embodiment under discussion, is constructed to be somewhat longer in axial direction than the mounting or attachment 20 and is connected at each end of the tube 16 with a ring member or ring 30 partially equipped at its periphery with teeth, and wherein each such ring 30 surrounds the tube or pipe 16. A respective pinion or small gear 32 meshingly engages with the teeth of the associated ring 30. Both of the pinions 32 are operatively interconnected with one another by a shaft 34 and thus provide a rotation-free i.e., contrained adjustment possibility for the throttle slide 28. To further facilitate the adjustment possibility of the throttle slide 28 one of the pinions 32 is meshingly engaged in not particularly illustrated manner, if desired via the agency of a further gear, with an adjustment ring which engages with such pinion. The adjustment of the throttle slide occurs as a general rule only during the initial regulation of the system when the apparatus is employed in conjunction with an air climatizing installation. It is however possible to carry out such adjustment by coupling the throttle slide with an automatic adjustment mechanism.

The throughpassage openings 18 of the tube 16 fulfill a double function. On the one hand, they insure for a uniform distribution of the air distributed through the conduits or lines 12 and 14 at the outlet nozzles 26, and, on the other hand, they serve in conjunction with the throttle slide 28 for adjusting the quantity of air which passes through the outlet apparatus. In this regard it is of significance that the location A, at which there is present a lesser density of the openings (e.g., accomplished by changing the number or diameter of such openings) is the last place which is shutoff by the throttle slide 28, so that there is realized a more compensated or balanced-out throttle characteristic.

However, it is also possible to non-uniformly distribute the openings 18 also in the direction of the axis of the tube or pipe 16 and to alternate such with solid portions of the shell or jacket of such tube. The associated throttle slide 28 would then likewise possess openings which, on the one hand, can be brought into coincidence with the openings 18 and, on the other hand, with the solid jacket portions of the tube, as desired. Furthermore, such throttle slide could be mounted to be adjustable in the axial as well as possibly additionally also in the peripheral direction of the tube 16.

The air outlet apparatus 10 can either form part of a tubular conduit and serve for the ventilation or climatizing of larger industrial areas or rooms where the aesthetic appearance constitutes a subordinate role. The air outlet apparatus furthermore can be mounted in a housing, if desired together with a heat exchanger and/or other installed components and can serve as a so-called high-pressure outlet. Finally, the air outlet apparatus can form part of an induction climatizing device and be mounted in a housing or a carrier frame or the like, wherein there is provided at least one inlet opening for secondary air and at least one heat exchanger for influencing the temperature of the secondary air as well as a common outlet for the admixed air. In this regard the air outlet apparatus is advantageously arranged in such a way that the secondary air can flow around all sides of the air outlet apparatus.

Figure 2:
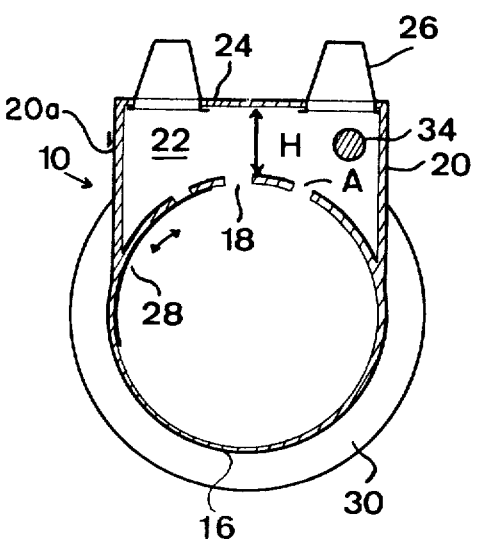
FIG. 2 is a cross-sectional view of the air outlet apparatus depicted in FIG. 1.

The advantages of the air outlet appratus of this development resides in the fact that the air infeed conduits of FIG. 1 can be connected either at the left, right or at both sides of the tube or pipe 16 as well as also radially or at an inclination at such tube. The air outlet apparatus portrayed by way of example in FIGS. 1 and 2 can be employed for a number of different purposes since it already constitutes a fully operational unit. It can be used as a conduit or pipe outlet, a component of a high-pressure outlet or a component of an induction climatizing device. Consequently, there is available a much larger range of use of the equipment and there is correspondingly afforded a much higher production rate, resulting in a more rational manufacture thereof. The continuous pipe or tube 16 of the air outlet apparatus — owing to the particular construction of the throttle device — enables connecting in series a number of high-pressure outlets or induction climatizing devices, wherein the departing quantity of air for each unit can be individually regulated.

When the equipment is used as a component of an induction climatizing device then with the flow of the secondary air to both sides of the air outlet apparatus there is realized a considerable improvement in the degree of the induction effect in contrast to an arrangement where the secondary air only flows around one side of the air outlet apparatus. Furthermore, there is attained a very small constructional height and thus an attendant saving in material. The throttle device possesses favorable adjustment characteristics, can be easily adjusted, is mechanically robust and simple in construction and nonetheless provides for a relatively noise-free operation. Due to the provision of the adjustment mechanism previously discussed which engages at both sides or ends of the throttle slide 28 there is realized an exact guiding and adjustability of the throttle slide 28 even in the case of greater structural length of the equipment. Furthermore, the air outlet apparatus of the invention permits of the construction of very compact induction climatizing devices with relatively small external dimensions, which nonetheless possess high output and low noise characteristics.

Instead of connecting the air outlet apparatus with a straight conduit such can also be connected through the agency of curved connection studs or pipes having an hydraulically smooth inner wall or surface.

While there is shown and described present preferred embodiments of the invention, it is to be distinctly understood that the invention is not limited thereto but may be otherwise variously embodied and practiced within the scope of the following claims. Accordingly,

What is claimed is:

1. An air outlet apparatus comprising a housing, at least one infeed conduit for operatively communicating the housing with an air preparation installation, said housing possessing an elongate substantially tubular-like body bounded by an outer surface, said tubular-like body being provided with throughpassage openings extending in the lengthwise direction thereof and at least over a portion of the outer surface, a mounting carried by said tubular-like body, said mounting having an outer wall, said outer wall enclosing a compartment between the mounting and the outer surface provided with said throughpassage openings of said tubular-like body, said throughpassage openings flow communicating the interior of said tubular-like body with said compartment, said mounting possessing a multiplicity of outlet openings distributively arranged in the axial direction of the tubular-like body, a portion of the tubular-like body being located internally of the mounting and said internally located portion of the tubular-like body being equipped with said throughpassage openings, a thin-foil throttle slide member positioned at said tubular-like body for coaction with said throughpassage openings thereof in order to regulate the flow of air between the interior of the tubular-like body into said compartment of the mounting and then through the outlet openings thereof, said thin-foil throttle slide member extending axially of the tubular-like body, and rotatable ring means cooperating with opposed ends of said thin-foil throttle slide member, means for operatively interconnecting said ring means at said opposed ends of said thin-foil throttle slide member with one another, rotation of any one of said ring means bringing about substantially equal circumferential movement of said thin-foil throttle slide member relative to the outer surface of said tubular-shaped body for selectively opening and closing said throughpassage openings.

2. The air outlet apparatus as defined in claim 1, wherein the outlet openings are provided at a surface of the mounting, and wherein the width of the surface containing the outlet openings approximately corresponds to the diameter of the tubular-like body.

3. The air outlet apparatus as defined in claim 2, wherein the diameter of the tubular-like body is substantially uniform over its length.

4. The air outlet apparatus as defined in claim 3, wherein the diameter of the tubular-like body is substantially equal to the diameter of said infeed conduit.

5. The air outlet apparatus as defined in claim 1, wherein the height of said mounting measured from the highest point of the tubular-like body amounts to about 10 to 40% of the diameter of the tubular-like body.

6. The air outlet apparatus as defined in claim 1, wherein said throughpassage opening extend essentially over the entire length of the mounting.

7. The air outlet apparatus as defined in claim 1, wherein the density of the throughpassages varies in the peripheral direction of the tubular-like body.

8. The air outlet apparatus as defined in claim 1, wherein the throttle slide member is mounted to be displaceable in the axial direction of the tubular-like body.

9. The air outlet apparatus as defined in claim 8, wherein said throttle slide member is provided with throughpassages which can be selectively brought into coincidence with the throughpassage openings and solid wall portions of the tubular-like body.

10. The air outlet apparatus as defined in claim 1, wherein the throttle slide member is arranged internally of the tubular-like body.

11. The air outlet apparatus as defined in claim 1, wherein the throttle slide member bears against a portion of the inner circumference of the tubular-like body.

12. The air outlet apparatus as defined in claim 14, wherein the density of the throughpassage openings varies in the peripheral direction of the tubular-like body, and wherein said rotatable ring means for the throttle slide member permits adjusting the throttle slide member into a position constituting a pronounced throttling and in which position the region of the tubular-like body provided with the reduced density of the throughpassage openings is not yet closed by the throttle slide member.

13. The air outlet apparatus as defined in claim 11, further including pinion means cooperating with said ring member.

14. The air outlet apparatus as defined in claim 13, wherein a respective one of said ring means and pinion means are arranged at each end of the tubular-like body and both pinion means are interconnected with one another by a shaft.

15. The air outlet apparatus as defined in claim 1, wherein the infeed conduit includes a terminal portion arranged in front of the tubular-like body and which terminal portion is curved and internally possesses a hydraulically smooth wall.

16. The air outlet apparatus as defined in claim 1, wherein said tubular-like body provides supporting means for said thin-foil throttle slide member.

17. An air outlet apparatus comprising an elongate substantially tubular-like body bounded by an outer surface, said tubular-like body being provided with throughpassage openings extending in the lengthwise direction thereof and at least over a portion of the outer surface, said throughpassage openings flow communicating the interior of said tubular-like body with a region located externally thereof, a substantially thin-foil throttle slide member positioned at said tubular-like body for coaction with said throughpassage openings thereof in order to regulate the flow of air between the interior of the tubular-like body and said externally located region, said thin-foil throttle slide member extending axially of the tubular-like body, and rotatable ring means co-operating with opposed ends of said thin-foil throttle slide member, means for operatively interconnecting said ring means at said opposed ends of said thin-foil throttle slide member with one another, rotation of any one of said ring means bringing about constrained circumferential movement of said thin-foil throttle slide member relative to the outer surface of said tubular-shaped body for selectively opening and closing said throughpassage openings.

* * * * *